US005377475A

United States Patent [19]

Haarer et al.

[11] Patent Number: 5,377,475

[45] Date of Patent: Jan. 3, 1995

[54] DEVICE FOR STERILIZING PACKAGING CONTAINERS

[75] Inventors: Rolf Haarer, Winterbach; Wolfgang Schmitt, Schorndorf-Weiler; Theodor Moser, Steinenberg, all of Germany

[73] Assignee: Robert Bosch GmbH, Stuttgart, Germany

[21] Appl. No.: 70,839

[22] Filed: Jun. 3, 1993

[30] Foreign Application Priority Data

Jun. 10, 1992 [DE] Germany ..... 4218941

[51] Int. Cl.[6] ..... B65B 3/02; B65B 55/10

[52] U.S. Cl. ..... 53/167; 53/426; 422/28; 422/304

[58] Field of Search ..... 422/26, 28, 304; 53/167, 426

[56] References Cited

U.S. PATENT DOCUMENTS

| | | | |
|---|---|---|---|
| 3,783,581 | 7/1974 | Pierce | 53/426 |
| 3,839,843 | 10/1974 | Stewart, Jr. | 53/426 |
| 3,911,640 | 10/1975 | Rausing | 53/426 |
| 4,014,158 | 3/1977 | Rausing | 53/167 |
| 4,409,775 | 10/1983 | Brody et al. | 53/426 |
| 4,622,800 | 11/1986 | Turtschan | 53/167 |
| 4,987,721 | 7/1991 | Turtschan . | |
| 5,173,259 | 12/1992 | Bordini | 53/167 |
| 5,251,423 | 10/1993 | Turtschan | 53/426 |

FOREIGN PATENT DOCUMENTS

| | | | |
|---|---|---|---|
| 3900448 | 7/1990 | Germany | B65B 55/06 |

*Primary Examiner*—W. Donald Bray

*Attorney, Agent, or Firm*—Edwin E. Greigg; Ronald E. Greigg

[57] ABSTRACT

A sterilization device on a filling and sealing machine for cup-shaped packaging containers has an endless conveying device in a sterilization chamber. The conveying device is equipped with carrier plates for the packaging containers has two deflection segments one above the other, and two vertical straight segments between them. A preheating device and a sterilization device for applying the sterilization medium are associated with the ascending straight segment, and a drying device is associated with the descending straight segment. The treatment medium, such as warm air, sterilization means and sterile drying air, are blown through nozzles descending into the conveyed containers. During passage through the upper deflection segment, the applied sterilization medium acts for a specific period of time: while the containers point downward with their openings. The containers occupy a horizontal position in the straight segments.

16 Claims, 1 Drawing Sheet

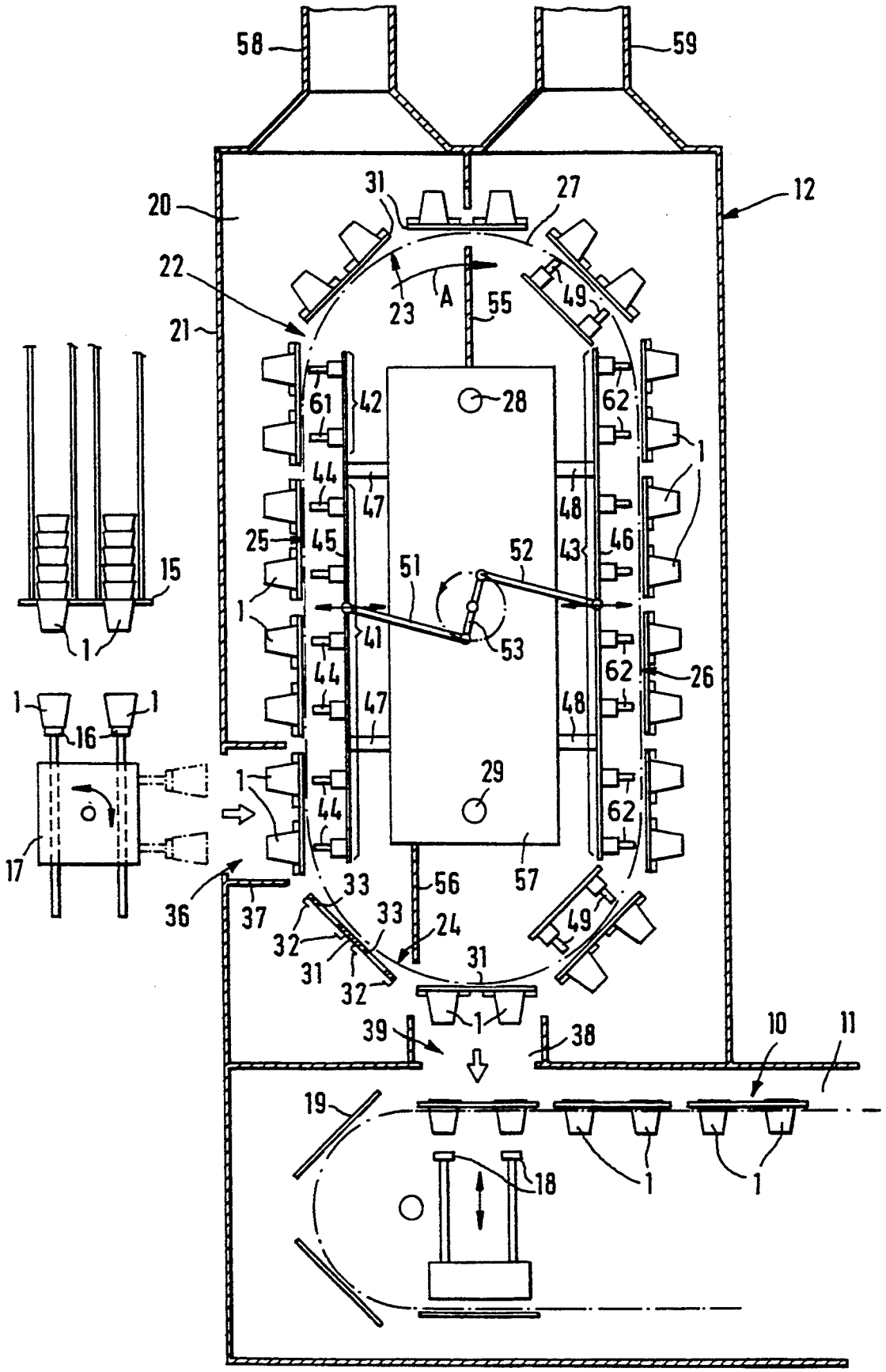
58
59
12
20
31
27
22
23
A
55
49
21
61
42
28
62
1
44
47
48
25
45
43
46
51
52
15
1
41
53
44
62
26
1
1
16
47
48
1
29
44
62
17
36
37
33
56
57
33
24
49
32
31
31
32
1
39
38
10
11
19
18
1
1

DEVICE FOR STERILIZING PACKAGING CONTAINERS

BACKGROUND OF THE INVENTION

The invention is based on a device for sterilizing cup-shaped packaging containers as defined hereinafter. With such an invention of this type, known from U.S. Pat. No. 3,783,581, for example, the packaging containers to be filled are removed separately from a stack and conveyed in succession through an inlet at the upper end area of the vertically extending sterilization chamber of the vertical, endless conveying device. This conveying device has crosswise extending carriers, on which respectively one packaging container is conveyed downward in an upright position and transferred at the lower end to the conveyor of the filling and sealing machine. Sterilization of the packaging container takes place during the downward motion of the packaging container, which is standing upright on the carriers, along a vertical straight segment of the conveying device, and superheated air or water steam moving from the sterile chamber of the filling and sealing machine acts on the containers in the sterilization chamber. The effectiveness of the known device leaves something to be desired, because residue of the sterilizing means and impurities can remain in the packaging containers. Moreover, filling and sealing the packaging containers is very difficult in a sterile chamber that is maintained at a high temperature level by means of superheated air or water steam.

A container-sterilizing device has further become known from German Published, Non-Examined Patent Application 39 00 448 with which the cup-shaped packaging container is taken separately from a vertical stack and guided downward by means of a plurality of worms engaging each other at a distance through a sterilization chamber, in the upper area of which an $H_2O_2$-steam mixture is supplied for sterilization; sterile hot air is supplied to the lower area. The $H_2O_2$-steam mixture is distributed on the cup walls as condensation film, which is subsequently dried by the hot air. With this known device, it is also not ensured that condensation residue and loose impurities will be safely removed from the packaging containers.

Therefore, a worthwhile goal is to create a sterilization device for packaging containers with which a high sterilization rate of the packaging containers can be achieved.

OBJECT AND SUMMARY OF THE INVENTION

The sterilization device in accordance with the invention has an advantage that, by means of the partly horizontal and partly vertical, downwardly pointing orientation of the opening of the packaging containers during their treatment, impurities or liquid sterilization means residue that may remain in the containers fall out of the containers or are rinsed out. The upper deflection segment of the conveying device that connects the two straight segments is available in an advantageous way during a certain period of time for the action of the previously applied sterilization medium. In addition, the arrangement in accordance with the invention of the treatment device on the conveying device allows for a very compact construction of the sterilization device.

Advantageous features and improvements of the sterilization device disclosed are possible by means of the measures disclosed herein. The embodiment of the conveying device is particularly advantageous: it allows the packaging containers to be assuredly taken from the carriers in a simple manner. Equipping the preheating device, the machine for applying the sterilization means and the drying device with nozzles that move into the containers contributes to the extraction of killed microorganisms, impurities and residue.

The invention will be better understood and further objects and advantages thereof will become more apparent from the ensuing detailed description of preferred embodiments taken in conjunction with the drawings.

BRIEF DESCRIPTION OF THE DRAWINGS

An exemplary embodiment of the invention is represented in the drawing, which shows a simplified representation in cross-section of the sterilization device, and will be explained in further detail below.

DESCRIPTION OF THE PREFERRED EMBODIMENT

A sterilization device 12 for prefabricated, cup-shaped packaging containers 1 to be aseptically filled rises towerlike above the inlet end of the housing of a filling and sealing machine for packaging containers 1 that operates aseptically, of which only a part of the cup conveyor 10 and the sterile chamber 11 that surrounds it are represented. These containers 1 are kept ready, stacked one inside the other in a supply stack 15, preferably in double stacks and, if necessary, in rows, are pulled off individually by suction heads 16 on a turret 17 and guided into the sterilization device 12. After sterilization, the containers 1 are carried down by the suction heads 18, which can move upward and downward, from the sterilization device and inserted into perforated catch plates 19 of the conveyor 10 of the filling and sealing machine, with which they are supplied to the filling and sealing devices (not shown).

In a sterilization chamber 20 that is surrounded by a housing 21, the sterilization device 12 has an endless conveying device 22 that has two deflection segments 23, 24 disposed one above the other, and two essentially vertical straight segments 25, 26 between them. The conveying device 22 is preferably formed of two conveyor chains 27 extending parallel beside each other that are guided in the deflection segments 23, 24 via deflection and driving wheels, not shown in more detail, rotating around parallel axles 28, 29 and of plates 31 linked on the outside to the conveyor chains 27. These plates 31 have clamps 32 on their outside that are adapted to the containers 1 and are oriented toward them for holding and carrying them. Preferably two holes 33 with associated clamps 32 are disposed next to each other in a plate 31; additional holes can be disposed in rows, one behind the other. The width of the holes 33 is adapted to the opening of the containers 1, which can be brought with the edge surrounding its opening, which can be embodied as a flange, into contact with the circumferential area of the holes 33 and held in position by the clamps 32.

The containers 1 to be sterilized are transferred to the conveying device 22, which is moved in steps in the direction of the arrow A, at the position a plate 31 occupies at the lower end of the moving vertical segment 25. The sterilization chamber 20 has a lateral inlet 36 with a horizontal lock 37 oriented toward this position. At this position the suction buckets 16 of the turret 17 push the containers 1 taken from the stack 15 through the lock 37 into contact with the ready plate 31, whose clamps 32 secure the containers 1 when the suction effect of the suction heads 16 is shut off.

The sterilized containers 1 are taken out of the sterilization device 12 by that plate 31 that entered at the summit of the lower deflection segment 24. The containers 1 that it carries are grasped by the suction heads 18 and set into the holes of the catch plates 19 of the cup conveyor 10 by means of a downward motion. In alignment with the apex of lower deflection segment 24 of the conveying device 22, the sterilization chamber 20 has an outlet 38 that at the same time is an inlet of the sterile chamber 11 of the filling and sealing machine. This outlet 38 is also embodied as a lock 39.

For sterilization particularly of the inside surface of the containers 1, a preheating device 41 and a device 42 for applying the sterilization means are disposed on the moving straight segment 25 of the conveying device 22, and a drying device 43 is disposed on the moving straight segment 26. The preheating device comprises nozzles 44 for ejecting hot air, the device 42 has nozzles 61 for ejecting a fluid sterilization medium and the drying device 43 has nozzles 62 for ejecting sterile air. These devices 41, 42, 43 have nozzles 44, 61 and 62 oriented toward the holes 33 of the plates 31 standing at individual stations and into the inside of the containers 1 carried by them. The nozzles 44, 62 are attached to two strips 45, 46, disposed parallel to the straight segments 25, 26 inside the chamber surrounded by the conveying device 22, in the grid arrangement of the holes 33 of the plates 31 standing ready in the stations of the straight segments 25, 26. The strips 45, 46 are preferably attached crosswise with respect to the straight segments 25, 26 to guide rods 47, 48 and are moved by means of couplers 51, 52 of a crank mechanism 53 toward and away from the straight segments 25, 26 during the time when the conveying device is stopped, so that the nozzles 44 and 62 move through the holes 33 of the plates 31 and partly into the ready containers 1 during a predetermined period of time. Additional nozzles 49 for warm air can be disposed inside the chamber surrounded by the conveying device 22 in the area of the deflection segments 23, 24, particularly near the ascending straight segment 26. To divide the sterilization chamber 20 into an unsterile chamber and a sterile chamber, the part with the moving straight segment 25 and the part with the moving straight segment 26 are separated by means of partitions 55, 56 and locks in the area of the deflection segments 23, 24, and by means of a centrally disposed housing 57. The housing 57 receives the drives (not shown) for the conveying device 22 and the nozzles 44, 62, and the feed devices for the treatment medium. The unsterile chamber and the sterile chamber of the sterile chamber 20 are ventilated by means of separate outlets 58, 59 in the head of the sterile chamber 20.

The described sterilization device operates as follows:

The conveying device 22 is moved in steps in the direction of the arrow A by the width of a plate 31 so that the plates 31 are temporarily stopped in the individual stations. During each stationary phase, two containers 1, for example, are pushed through the lateral inlet 36 into the sterilization chamber 20 by the suction heads 16 and transferred there to the ready plate 31. At the same time, containers 1 carried by a plate 31 into the apex of the lower deflection segment 24 are grasped by the suction heads 18 and carried out of the sterilization chamber 21 into the conveyor 11 of the filling and sealing machine. During further cyclical operation of the conveying device 22, the containers 1 are conveyed from station to station of the conveying device 22, wherein they first pass, in a horizontal orientation, the preheating device 41 and the device 42 for applying the sterilization medium on the ascending straight segment 25, then the segment with their opening pointing downward, the upper deflection segment 23; afterwards, again in a horizontal orientation, the drying device 43 on the moving straight segment 26. During the stopped phases the nozzles 44, 62 move into the containers 1. Warm air is blown into the containers 1 in the area of the preheating device 41, a vapor or mist of sterilizing medium is blown into the containers 1 in the area of the device 42 for applying the sterilization medium, and sterile warm air in the area of the drying device 43. The application of the treatment medium by the moving nozzles 44, 62 flows advantageously and covers the surface, resulting in a uniform application with a very high degree of effectiveness. The sterilization medium, preferably $H_2O_2$, applied to the containers 1 in the upper part of the moving straight section 25 and covering the inside wall as a film is effective for a specific period of time: while the containers pass through the upper deflection segment 23. When sterile warm air is blown onto the moving straight segment 26, the sterilization medium is rinsed out or evaporated without leaving a residue, so that the containers 1 can be transferred germ-free into the filling and sealing machine.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent or the United States is:

1. A device for sterilizing cup-shaped packaging containers before they are filled in a filling and sealing machine, comprising a cup conveyor (10) which conveys the containers in a sterile chamber (11) on a horizontal plane by means of said cup conveyor (10) in a direction of the filling and sealing devices, having a vertically disposed sterilization chamber (20) that is connected to the sterile chamber via a lower outlet opening, an endless conveying device (22) in said sterilization chamber, said endless carrying device includes spaced carriers (31) which carries and guides the individual containers in succession from an inlet (36), guides them through a sterilization zone and transfers them through the lower outlet opening to the cup conveyor (10) of the filling and sealing machine, the endless conveying device comprises an upper and a lower deflection segment and first and second essentially vertical straight segments between the upper and lower deflection segments, the carriers (31) of the endless conveying device (22) support each of the containers (1) and an opening of each of the containers points toward a chamber portion surrounded by the endless conveying device; in a direction of conveyance of the conveying device (22), a preheating device (41) and a sterilization device (42) downstream of the preheating device for applying a sterilization medium to the individual containers carried by the first vertical straight segment (25), with which the inlet (36) at a lower end is associated, and a drying device (43) is associated with the second vertical straight segment (26), said preheating, sterilization and drying devices (41, 42, 43) are disposed in the chamber portion surrounded by the endless conveying device (22).

2. The sterilization device as defined by claim 1, in which the carriers (31) are plate-shaped with at least one opening (33), and that clamps (32) are associated with the opening (33) so that the openings of the containers (1) being held on the carriers by clamps (32) coincide with the openings (33) of the carriers (31).

3. The sterilization device as defined by claim 2, in which the preheating device (41), the sterilization device (42) for applying the sterilization medium and the drying device (43) have nozzles (44, 61, 62), through which the respective treatment fluid flows into the inside of the containers (1) supported by the carriers (31).

4. The device as defined by claim 3, in which the nozzles (44, 62) are disposed in strips (45, 46)) that extend parallel to the straight segments (25, 26) of conveying device (22) and are displaceable crosswise to the straight segments (25, 26) for dipping of the nozzles (44, 62) into the ready containers (1).

5. The sterilization device as defined by claim 1, in which the sterile chamber (20) is divided into an unsterile chamber with the straight segment (25) of the conveying device (22) movable and a sterile chamber with the straight segment (26) of the conveying device (22) movable.

6. The sterilization device as defined by claim 2, in which the sterile chamber (20) is divided into an unsterile chamber with the straight segment (25) of the conveying device (22) movable and a sterile chamber with the straight segment (26) of the conveying device (22) movable.

7. The sterilization device as defined by claim 3, in which the sterile chamber (20) is divided into an unsterile chamber with the straight segment (25) of the conveying device (22) movable and a sterile chamber with the straight segment (26) of the conveying device (22) movable.

8. The sterilization device as defined by claim 4, in which the sterile chamber (20) is divided into an unsterile chamber with the straight segment (25) of the conveying device (22) movable and a sterile chamber with the straight segment (26) of the conveying device (22) movable.

9. The sterilization device as defined by claim 1, in which the inlet (36) for the containers (1) to be sterilized is associated with the lower end of the movable straight segment (25) of the conveying device (22).

10. The sterilization device as defined by claim 2, in which the inlet (36) for the containers (1) to be sterilized is associated with the lower end of the movable straight segment (25) of the conveying device (22).

11. The sterilization device as defined by claim 3, in which the inlet (36) for the containers (1) to be sterilized is associated with the lower end of the movable straight segment (25) of the conveying device (22).

12. The sterilization device as defined by claim 4, in which the inlet (36) for the containers (1) to be sterilized is associated with the lower end of the movable straight segment (25) of the conveying device (22).

13. The sterilization device as defined by claim 5, in which the inlet (36) for the containers (1) to be sterilized is associated with the lower end of the movable straight segment (25) of the conveying device (22).

14. The sterilization device as defined by claim 6, in which the inlet (36) for the containers (1) to be sterilized is associated with the lower end of the movable straight segment (25) of the conveying device (22).

15. The sterilization device as defined by claim 7, in which the inlet (36) for the containers (1) to be sterilized is associated with the lower end of the movable straight segment (25) of the conveying device (22).

16. The sterilization device as defined by claim 8, in which the inlet (36) for the containers (1) to be sterilized is associated with the lower end of the movable straight segment (25) of the conveying device (22).

* * * * *